US006247288B1

(12) United States Patent
Harkins

(10) Patent No.: US 6,247,288 B1
(45) Date of Patent: Jun. 19, 2001

(54) ROOF FABRIC DISPENSING DEVICE

(75) Inventor: Daniel J. Harkins, Staughton, WI (US)

(73) Assignee: Guardian Fiberglass, Inc., Albion, MI (US)

( * ) Notice: Subject to any disclaimer, the term of this patent is extended or adjusted under 35 U.S.C. 154(b) by 0 days.

(21) Appl. No.: 09/392,716

(22) Filed: Sep. 9, 1999

(51) Int. Cl.[7] ..... E04B 1/00

(52) U.S. Cl. ..... 52/746.11; 52/749.12

(58) Field of Search ..... 52/746.11, 749.12, 52/63

(56) References Cited

U.S. PATENT DOCUMENTS

| | | |
|---|---|---|
| 1,587,842 | 6/1926 | Knox . |
| 2,041,910 | 5/1936 | Ericson . |
| 2,587,985 | 4/1952 | Elmendorf . |
| 2,861,525 | 11/1958 | Curtis et al. . |
| 3,121,649 | 2/1964 | Oliver . |
| 3,135,070 | 6/1964 | Waring et al. . |
| 3,307,306 | 3/1967 | Oliver . |
| 3,559,914 | 2/1971 | Alderman . |
| 3,619,437 | 11/1971 | McDonald . |
| 3,662,509 | 5/1972 | Studzinski . |
| 3,694,306 | 9/1972 | Fricklas . |
| 3,729,879 | 5/1973 | Franklin . |
| 3,735,538 | 5/1973 | Ramins . |
| 3,835,604 | 9/1974 | Hoffman, Jr. . |
| 3,845,602 | 11/1974 | Alderman . |
| 3,861,616 | 1/1975 | Dubberke . |
| 3,969,863 | 7/1976 | Alderman . |
| 4,014,150 | 3/1977 | Wells et al. . |
| 4,031,681 | 6/1977 | Charniga . |
| 4,047,345 | 9/1977 | Alderman . |
| 4,047,346 | 9/1977 | Alderman . |
| 4,050,972 | 9/1977 | Cardinal, Jr. . |
| 4,075,807 | 2/1978 | Alderman . |
| 4,147,003 | 4/1979 | Alderman . |
| 4,151,692 | 5/1979 | Holcombe . |
| 4,213,282 | 7/1980 | Heckelsberg . |
| 4,222,212 | 9/1980 | Alderman . |
| 4,233,791 | 11/1980 | Kuhl et al. . |
| 4,296,581 | 10/1981 | Heckelsberg . |
| 4,303,713 | 12/1981 | Clemensen et al. . |
| 4,329,823 | 5/1982 | Simpson . |
| 4,333,291 | 6/1982 | Musgrave et al. . |
| 4,333,292 | 6/1982 | Musgrave . |
| 4,361,993 | 12/1982 | Simpson . |
| 4,391,075 | 7/1983 | Musgrave . |
| 4,393,634 | 7/1983 | McDermott et al. . |
| 4,446,664 | 5/1984 | Harkins . |
| 4,446,665 | 5/1984 | Berger . |
| 4,528,789 | 7/1985 | Simpson . |
| 4,528,790 | 7/1985 | Lo et al. . |
| 4,548,016 * | 10/1985 | Dubich et al. ..... 52/749.12 |
| 4,557,092 | 12/1985 | Brueske . |
| 4,566,239 | 1/1986 | Smigel et al. . |
| 4,602,468 | 7/1986 | Simpson . |

(List continued on next page.)

OTHER PUBLICATIONS

Owens–Corning Elaminator Sales and Instruction Training Video 100 Series, 1994.

Owens Corning Elaminator Insulation System, 1996.

Owens Corning System Thinking advertisement, 1998.

Dispense–R Insulation System by Thermal Design, 1998.

Perfect R Application System by CGI Silvercote Inc.

*Primary Examiner*—Jose V. Chen
(74) *Attorney, Agent, or Firm*—Hall, Priddy, Myers & Vande Sande

(57) ABSTRACT

A device for installing roof fabric on the roof of a metal frame building having a plurality of parallel purlins on the top thereof. The device retains a spool of fabric therein and includes a frame having a guide that movably slides on the top of the purlin and a tensioning device that engages a lower surface of the purlin, whereby movement of the device allows the fabric to unroll over the roof.

15 Claims, 8 Drawing Sheets

U.S. PATENT DOCUMENTS

| | | | | |
|---|---|---|---|---|
| 4,635,423 | | 1/1987 | Ward . | |
| 4,637,188 | | 1/1987 | Crothers . | |
| 4,656,808 | * | 4/1987 | Mansfield | 52/749.12 |
| 4,699,484 | | 10/1987 | Howell et al. . | |
| 4,709,523 | | 12/1987 | Broderick et al. . | |
| 4,711,407 | | 12/1987 | Boon . | |
| 4,736,552 | | 4/1988 | Ward et al. . | |
| 4,967,535 | | 11/1990 | Alderman . | |
| 5,195,764 | | 3/1993 | Schantz et al. . | |
| 5,205,103 | * | 4/1993 | Burton | 52/649.12 |
| 5,381,597 | * | 1/1995 | Petrove | 52/749.12 X |
| 5,491,952 | | 2/1996 | Alderman et al. . | |
| 5,495,698 | | 3/1996 | Alderman et al. . | |
| 5,551,203 | | 9/1996 | Alderman et al. . | |
| 5,561,959 | | 10/1996 | Alderman et al. . | |
| 5,653,081 | | 8/1997 | Wenrick et al. . | |
| 5,653,083 | | 8/1997 | Alderman et al. . | |
| 5,664,740 | | 9/1997 | Alderman et al. . | |
| 5,685,123 | | 11/1997 | Alderman et al. . | |
| 5,720,147 | | 2/1998 | Wenrick et al. . | |
| 5,746,077 | | 5/1998 | Zaccagni . | |
| 5,784,966 | | 7/1998 | Brown et al. . | |
| 5,911,385 | * | 6/1999 | Neifer et al. | 52/749.12 X |

* cited by examiner

ROOF FABRIC DISPENSING DEVICE

BACKGROUND OF THE INVENTION

1. Technical Field

This invention relates to a device for use with rolled roof fabric and more particularly to a device for the installation of roof fabric on the roof purlins or joists of a metal framed building.

2. Description of the Prior Art

Metal frame buildings typically comprise a roof formed of a series of parallel rafters which extend from one side of the building to the other side of the building, forming a center peak that runs from the front of the building to the back of the building. A series of parallel purlins are supported on the rafters and are mounted perpendicular to the rafters. Typically, roof fabric is laid over the purlins and may be followed by insulation material and then roof sheeting. The roof fabric may comprise woven material, a membrane of plastic or other substance, or any sheet of material. Roof fabric may also be used on building systems generally, for example, as a floor moisture barrier.

Installation of these materials on the roofs of metal framed buildings has typically been accomplished by hand. Such installation is dangerous under ideal conditions and is extremely dangerous and haphazard under less than ideal conditions, such as high wind.

Machinery that can apply the fabric to the roof of a building can minimize the danger to workmen and improve the quality of the finished roof. Several such devices have been patented to Robert J. Alderman such as the device shown in U.S. Pat. No. 5,495,698. In this and the other devices patented by Mr. Alderman, a roll of insulation material is suspended on a carriage above the roof. The carriage rests on at least two purlins and is moved along the length of the purlins, thereby unrolling the fabric over the roof. In the structures of all the devices patented by Alderman, in addition to all the similar devices known to the applicant, the fabric to be rolled onto the roof is held by supports on either end of the roll. This structure has the disadvantage of limiting the width of fabric which may be rolled onto the roof. Also, the prior art devices rest on at least two purlins, further preventing the use of the devices on any purlins that are separated by a non-standard distance. In addition, the prior art devices are bulky and difficult to transport and place on a roof.

The roof fabric, ideally, should be installed on the roof such that there are no gaps in the material. Accordingly, wider rolls of fabric are desirable because installation of the wider rolls results in fewer seams and less potential for such gaps. Furthermore, in the known prior art structures, the devices must be operated by a workman present on the roof. No known prior art structures allow for the operation of the device by a workman on the ground.

SUMMARY OF THE INVENTION

The present invention comprises a device for installing roof fabric on the roof on a metal frame building having rafters extending from one side of the building to the other side of the building and supporting essentially parallel purlins or joists on the top thereof. The device includes an elongated frame, a guide on the front end of the frame, a tensioning device on the center of the frame, and an engagement means on the rear end of the frame for retaining a spool of fabric.

It is an object of this invention to provide a device for installing roof fabric which is safe and effective to use.

Another object of this invention is to provide a roof fabric installation device which can produce a roof on a metal frame building that has a minimal number of seams, that effectively covers, seals, or insulates a building, and that is economical to install.

It is a further object of this invention to provide a self-propelled roof fabric installation device.

Another object of this invention is to provide a roof fabric installation device that is operable by a remote device.

Another object of this invention is to provide a roof fabric installation device which is lightweight and easily maneuverable.

Yet another object of this invention is to provide a device which may be safely operated regardless of weather conditions.

These and other objects of the invention will be apparent when read in conjunction with the accompanying drawings.

DESCRIPTION OF THE PREFERRED EMBODIMENT

Figure 1:
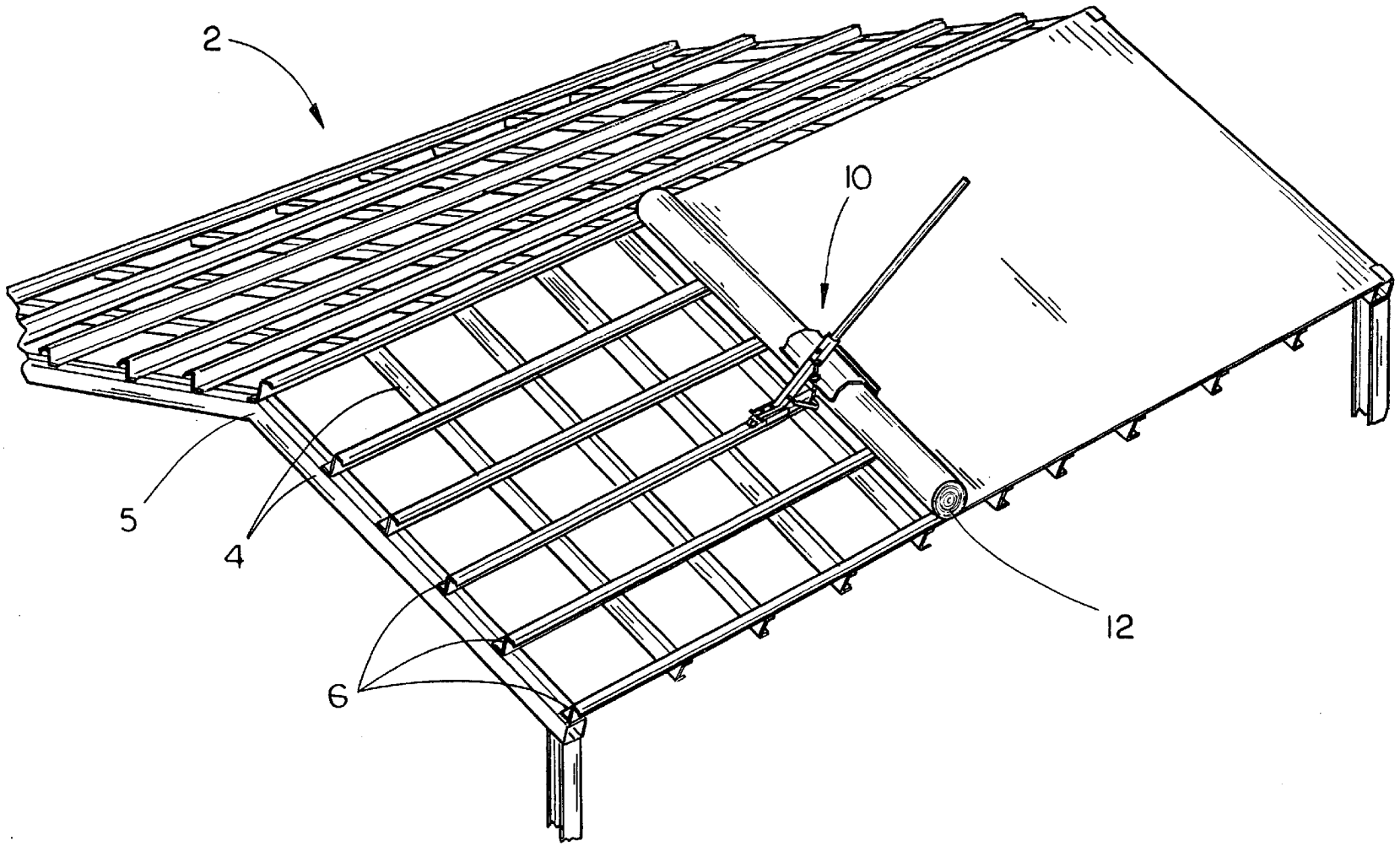
FIG. 1 is a partial perspective view of a roof structure and the roof fabric dispensing device, showing the manner in which the fabric is applied to the roof.
Figure 2:
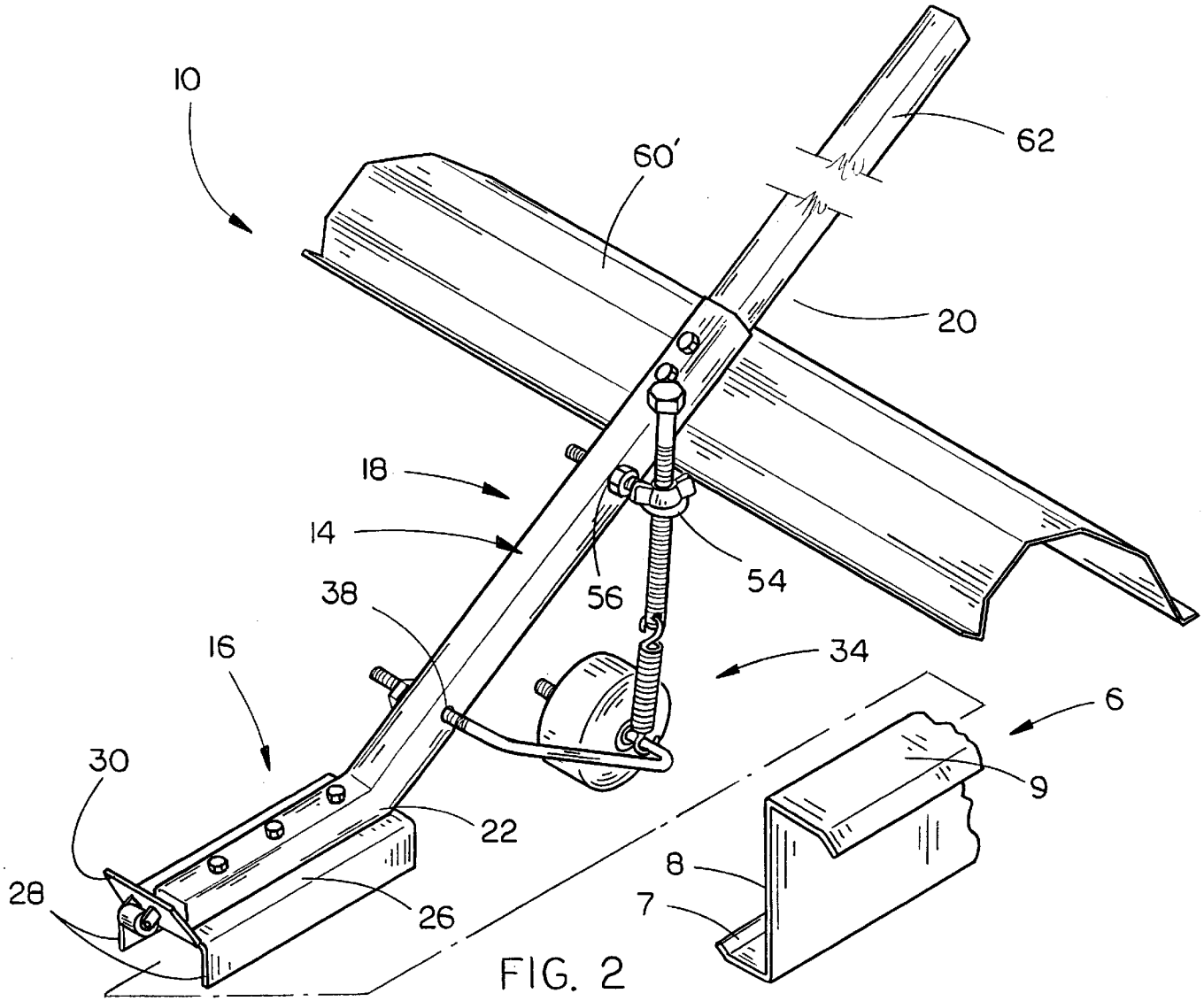
FIG. 2 is a perspective view of the device.

Referring now in more detail to the drawings, FIG. 1 shows a roof framework 2 which includes rafters 4 extending parallel to each other across the width of the building to a peak 5 at the center of the building. A plurality of spaced-apart purlins 6, also referred to as joists, extend along the length of the building and are supported by the rafters 4 in conventional fashion. The purlins 6 may constitute conventional purlins, joists, girders, or any other building structure regardless of design, composition, or manner of use. The purlins 6 are generally Z-shaped, C-shaped, or I-shaped, and include a bottom flange 7, a central web 8 and a top flange 9. The purlins 6 are generally placed in substantially parallel relation to one another.

FIG. 1 shows the roof fabric dispensing device of this invention designated generally at 10, for applying rolled roof fabric 12 to the roof 2. The roof fabric dispensing device 10 is shown in more detail in FIGS. 2–8. It includes an elongated frame 14 having a front end 16, a center 18, and a rear end 20. Preferably, the elongated frame 14 includes an angled portion 22 between the front end 16 and the center section 18.

The front end 16 incorporates a guide 24 that may be attached by bolts 25 or otherwise integrated therewith.

Preferably, the guide 24 includes a substantially flat central plate 26 and downwardly extending flanges 28 on either side thereof. The downwardly extending flanges 28 should be designed to embrace the top flange 9 of a purlin 6. The guide 24 may also include an angled plate 30 positioned at the forward end thereof. The purpose of the guide 24 is to allow the movement of the device 10 along the length of a purlin 6 with a minimal amount of friction. This may be accomplished by incorporation of an optional wheel or wheels 32 positioned on the guide 24, construction of the guide 24 with low friction materials, such as nylon, or other means known in the art.

The center section 18 of the frame 14 preferably includes a tensioning device 34. The tensioning device 34 engages the underside of the top flange 9 of a purlin 6 to draw the rear end 20 of the frame 14 toward the purlin 6. One embodiment of the tensioning device 34 is shown in FIGS. 2–5. The tensioning device includes a U-shaped bolt 36 having a first end 37 rotatably journaled through a hole 38 in frame 14 and secured thereto by the securing device, shown as at least one nut 40. The U-bolt 36 extends downwardly to a second end 42 thereof on which is mounted a wheel 44 or other low friction device. A tension spring 46 is attached to the second end 42 of the U-bolt 36 and extends upwardly to an adjustable catch 48. The catch 48 may be adjustable by any design, one of which is shown is in FIG. 2. In the embodiment shown in FIG. 2, the catch 48 is integrated on a threaded bolt 50. The threaded bolt 50 threadably receives a wing nut 52 and is journaled through an eyebolt 54. The eyebolt 54 is fitted into a hole 56 in the frame 14 and secured therein by at least one nut 58. By this structure, the tension of the spring 46 may be adjusted by rotation of the wing nut 52. The tension of the spring 46 maintains the wheel 44 against the underside of the top flange 9.

The rear end 20 of the frame 14 has attached to it a fabric engagement means 60 for holding the rolled roofing fabric 12. The engagement means 60 may be attached to the frame 14 by bolts 59 or any conventional means. As shown is FIG. 2, the engagement means 60 may comprise an elongated metal sheet 60' having a generally arcuate profile. The engagement means 60 may include other designs and materials. The engagement means 60 may be comprised of nylon or some other lightweight low friction material. The engagement means 60 may also be comprised of a series of rollers 61 or arcuate wire tines (not shown). The engagement means 60 must retain the roll of roof fabric 12 therein while allowing the roll 12 to unfurl over the roof 2, and generally retain the roll tautly to the purlins.

Figure 6:
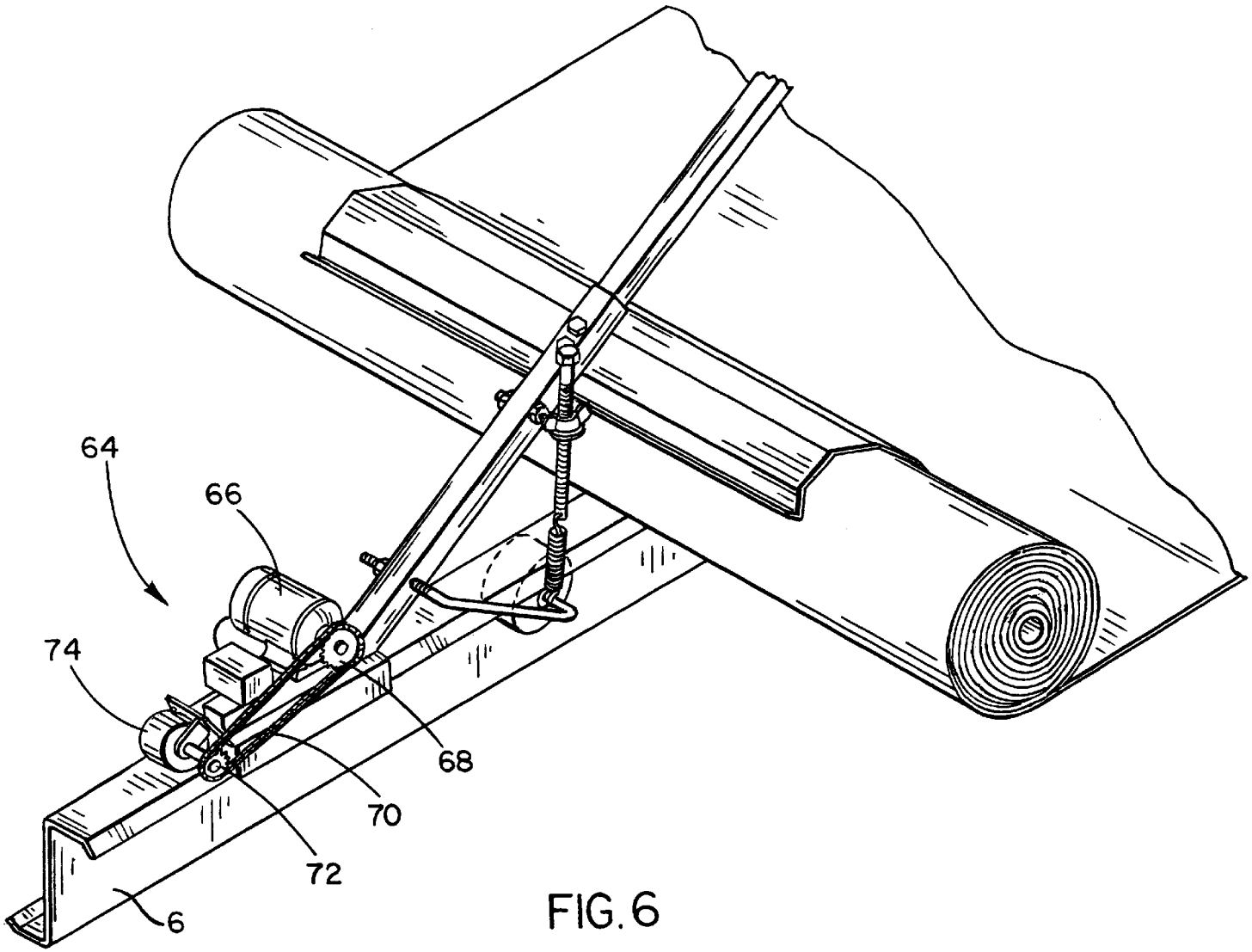
FIG. 6 is a perspective view of the device having a motor attached to the front end thereof.

The device 10 may be moved along the purlins 6 using several different methods. Most simply, an extended handle 62 may be attached to the rear end 20 of the frame 14 for manual movement of the device 10. Alternatively, the front end of the guide 24 may be provided with a hook or loop 101 through which a rope or wire 103 may be threaded to pull the device 10 along the purlin 6. The rope or wire may be mechanically driven (e.g. by motor 105). In yet another embodiment, the device 10 may be provided with a motorized drive 64. As shown in FIG. 6, the front end 16 of the frame 14 supports a motor 66. The motor 66 includes a drive gear 68 which is in operational engagement with the drive belt 70. The drive belt 70 engages a secondary gear 72 which is attached to front drive wheel 74. The front drive wheel 74 rests on the purlin 6 and, upon rotation of drive gear 68 by the motor 66, moves the device 10 along the purlin 6.

Figure 7:
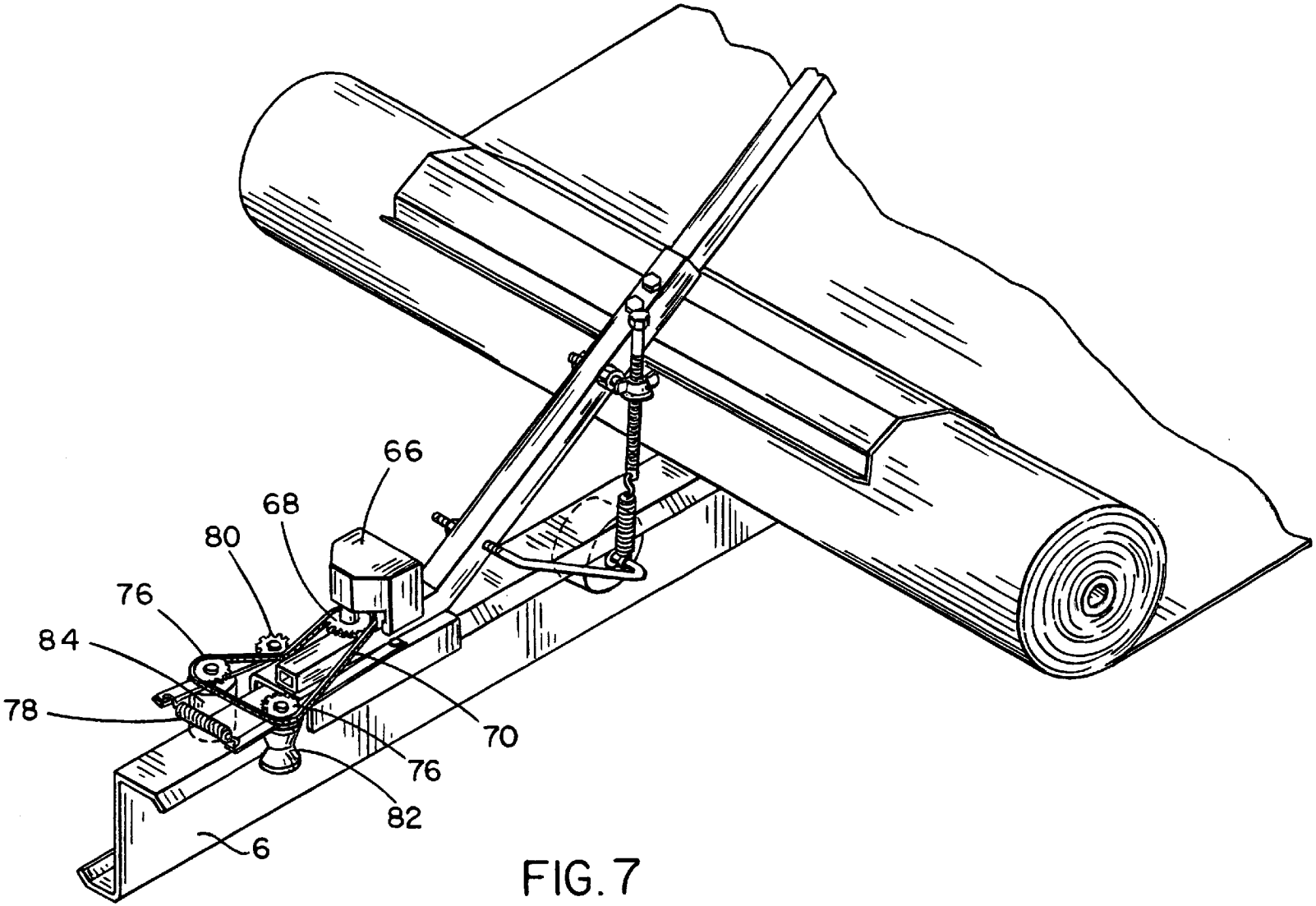
FIG. 7 is a perspective view of the device having a second embodiment of a motor attached to the front end thereof and a remote control for controlling such motor.

Similarly, FIG. 7 shows a motor 66 mounted on the front end 16 of the frame 14. The motor 66 has attached to it drive gear 68, which is in operational engagement with drive belt 70. The drive belt 70 engages opposing drive gears 76. The opposing drive gears 76 are mounted on and operatively connected to opposing drive wheels 82 and 84. The opposing drive wheels 82 and 84 are biased against the sides of top flange 9 of the purlin 6 by tension spring 78. The drive belt 70 is retained in operational engagement with opposing drive gears 76 by idler sprocket 80. Drive wheel 84 includes a differential (not shown) which requires wheel 84 to rotate in a direction opposite that of the associated drive gear 76. The rotation of the drive gear 68 by the motor 66, therefore, causes the rotation of opposing drive wheels 82 and 84 and the movement of the device 10 along the purlin 6.

Figure 8:
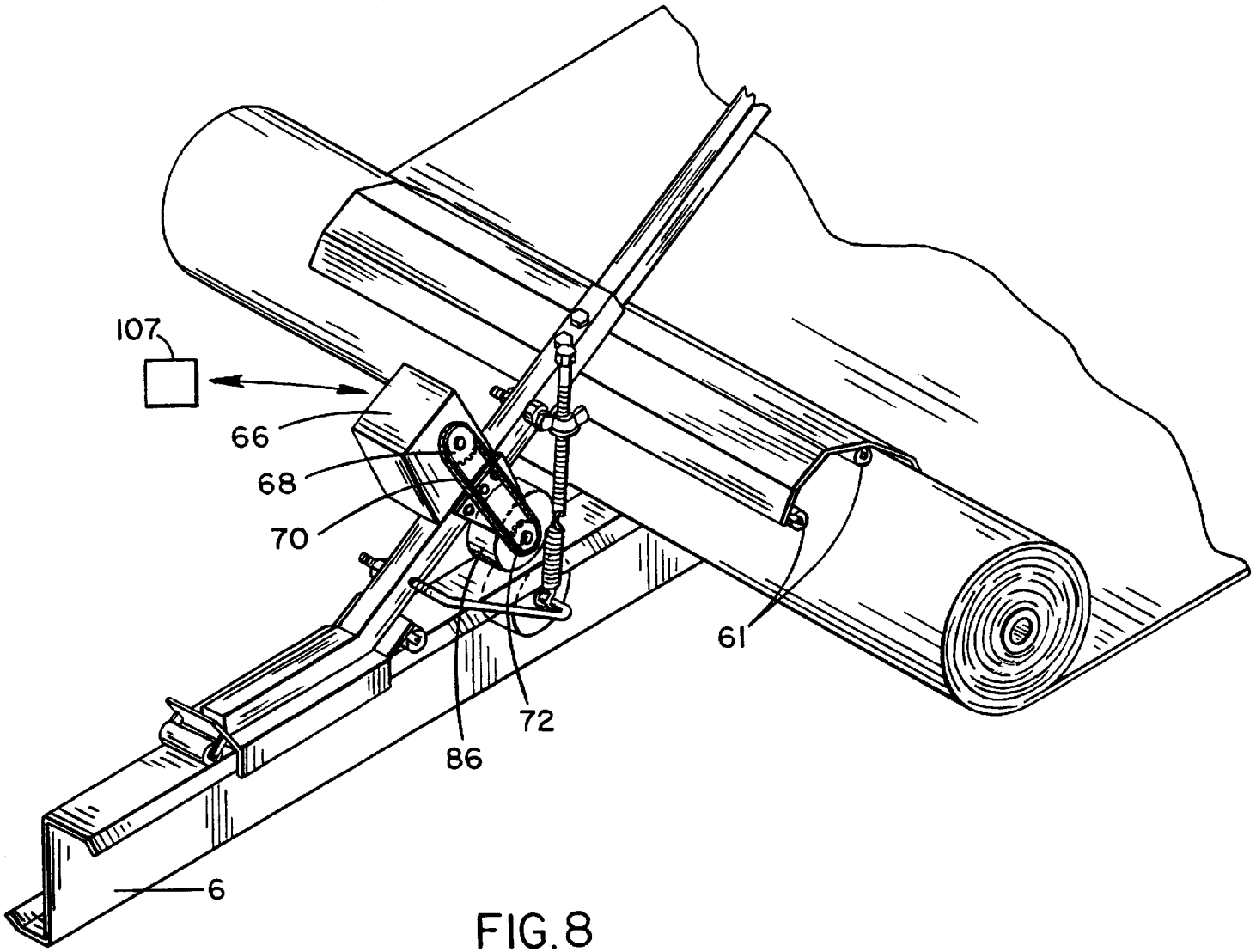
FIG. 8 is a perspective view of the device having a motor attached to the middle section thereof.

Other configurations for a motor mounted on the front end 16 of the frame 14 are possible and the examples shown in FIGS. 6 and 7 are not intended to be exhaustive, but only exemplary. Similarly, the motor may be mounted on the frame in a position other than on the front end 16. FIG. 8 shows the motor 66 mounted on the center section 18 of the frame 14. Like the previously described devices, the motor 66 includes a drive gear 68 which is in operational engagement with the drive belt 70. The drive belt 70 engages a secondary gear 72 which is attached to a center drive wheel 86. Although the center drive wheel 86 is shown in fixed relationship with the center section 18 of the frame 14, such a center drive wheel will be, preferably, connected to the center section 18 in a variable relationship which will allow for the change in height of the roll of fabric, as will be discussed in greater detail hereinafter. These and other configurations are contemplated by this disclosure.

Figure 9:
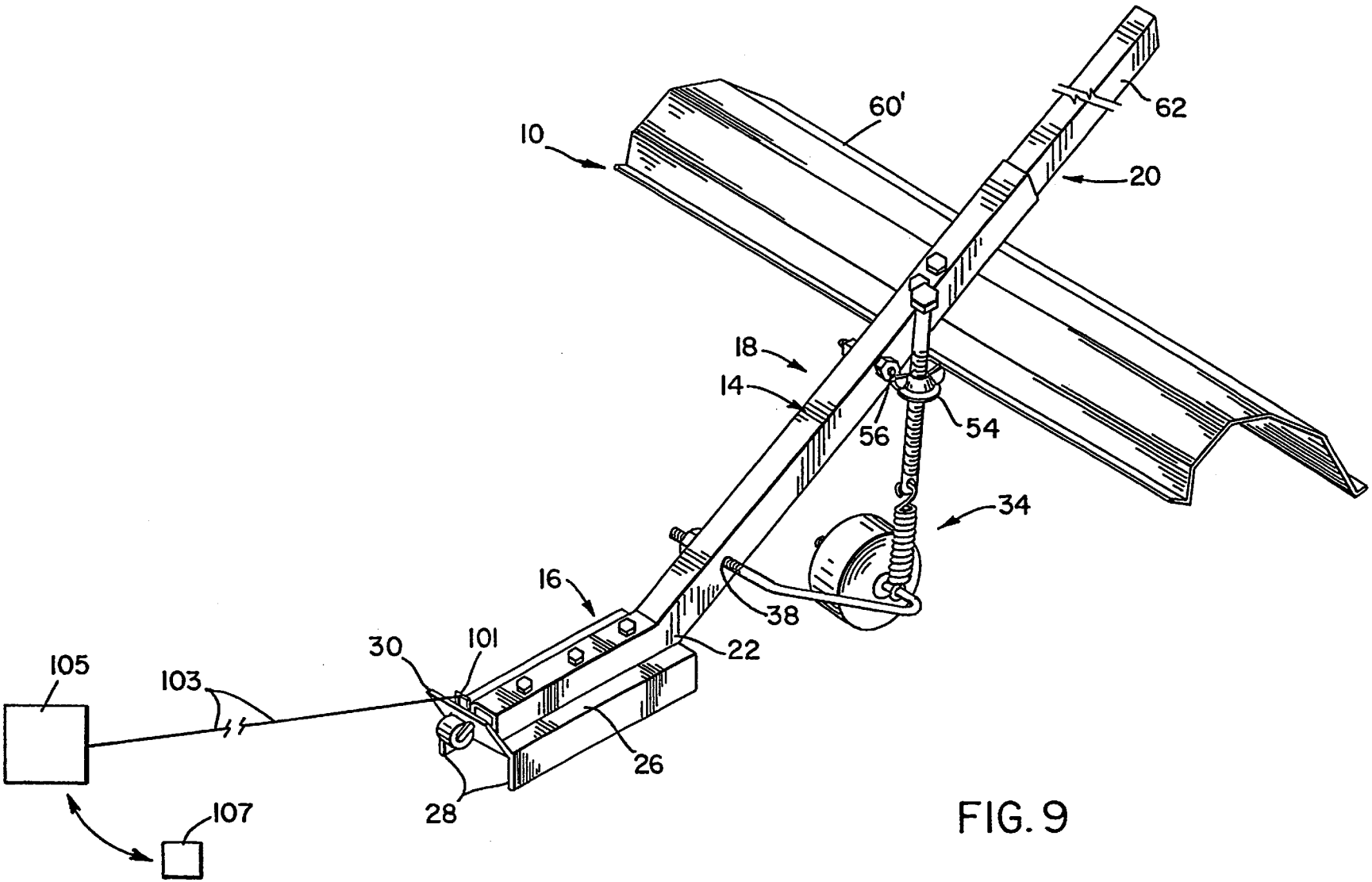
FIG. 9 is a three-dimensional perspective view of one embodiment of the device of FIG. 2.

The motor 66 may be operated by a conventional control mechanism (not shown). The control mechanism may be positioned on the motor 66, the handle 62, or elsewhere on the device 10, and provided with a conventional on/off switch or similar controls. Preferably, however, the control mechanism is operated by a conventional remote control device 107 (e.g. as shown in FIGS. 8 and 9) which is in communication with the motor control mechanism through RF, IR, or other conventional communication means.

Figure 3:
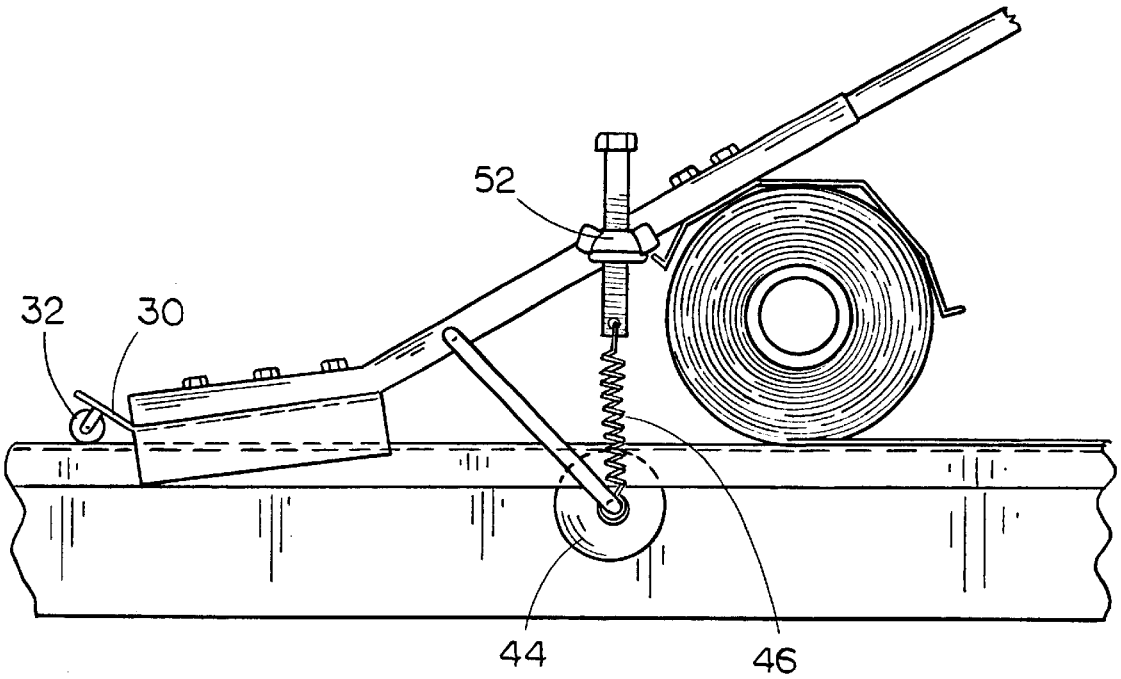
FIG. 3 is a right side elevational view of the device holding a full roll of fabric.
Figure 4:
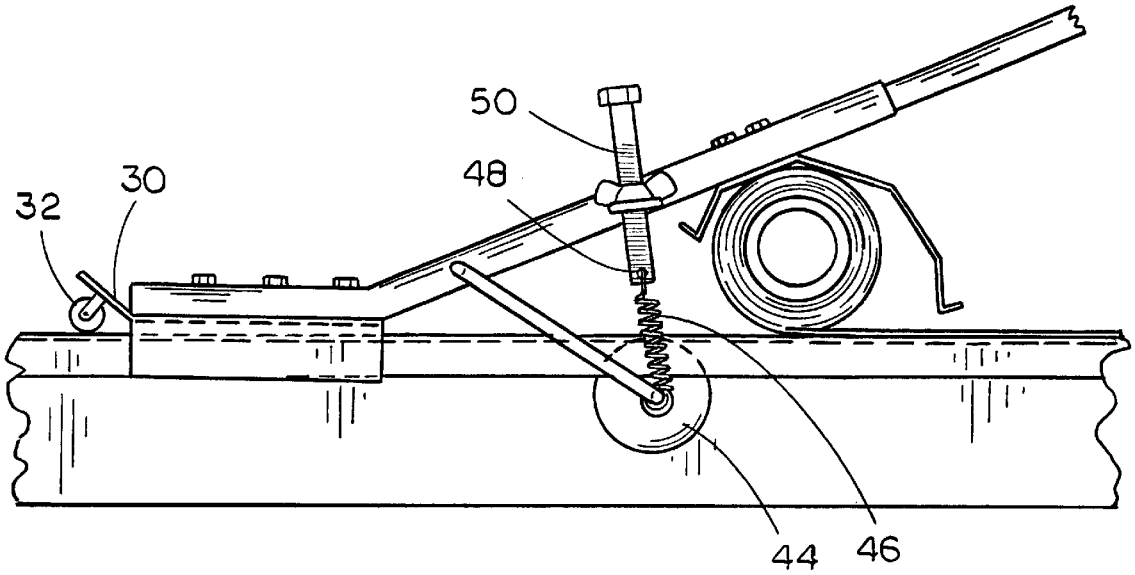
FIG. 4 is a right side elevational view of the device holding a depleted roll of fabric.
Figure 5:
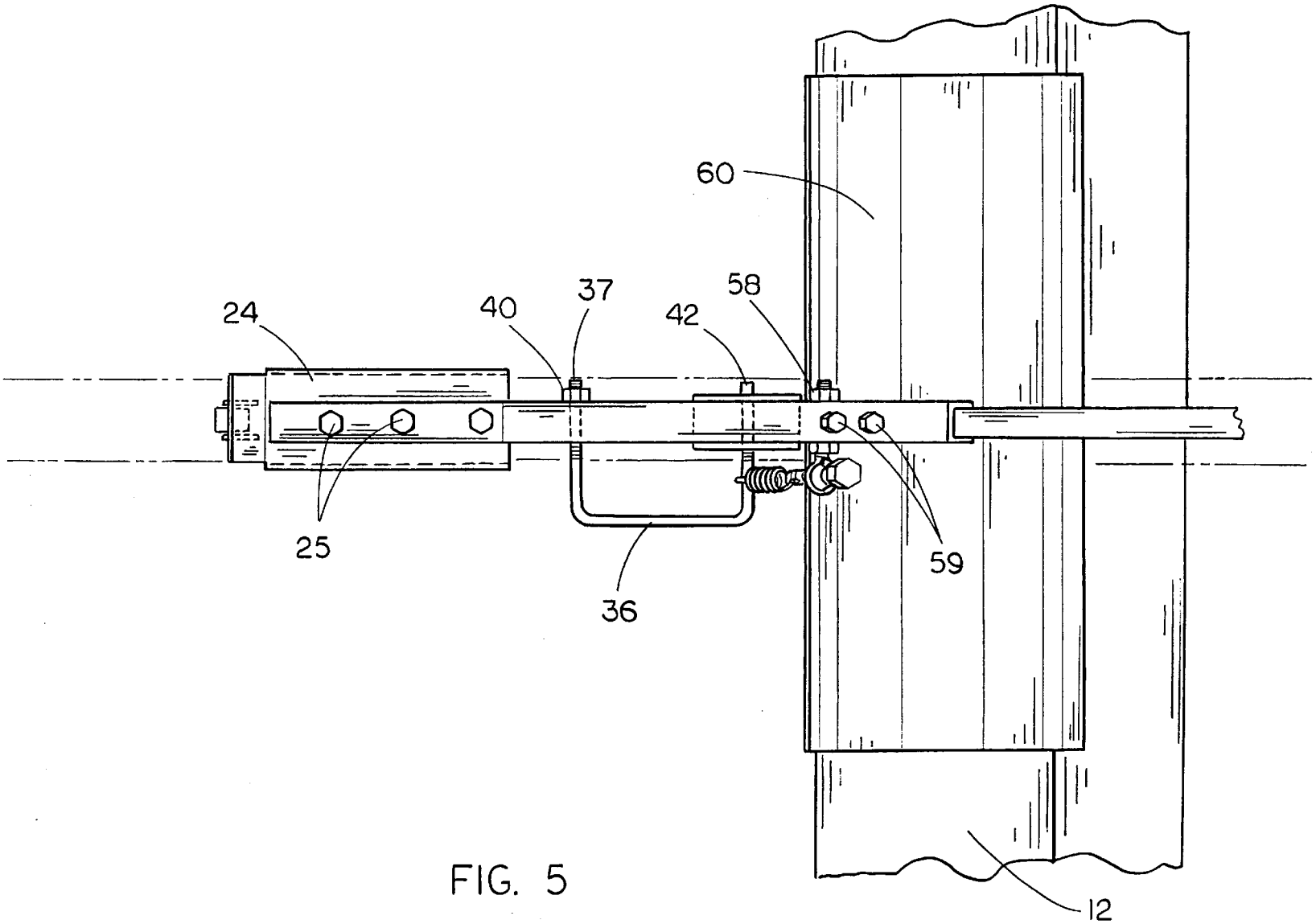
FIG. 5 is a top elevational view of the device.

In operation, the roll of roof fabric 12 is positioned at one end of the roof perpendicular to the purlins 6. The exposed end of the rolled fabric 12 is secured to the ends of the purlins 6, or to any position on the purlins 6 from which the roof fabric 12 is to be installed. The device 10 is placed on the roof 2 and the rolled fabric 12. The front guide 24 is positioned on a purlin 6 and the engagement means 60 is positioned on the rolled fabric 12. The tensioning wheel 44 is positioned on the underside of the top flange of that same purlin. If no tensioning wheel 44 is used, gravity may be employed to retain the device 10 on the purlin 6 and the roof fabric 12. The device 10 is moved across the purlins 6 by either manual manipulation of the handle 62, by drawing the device 10 across the roof by a rope or cable, or by operation of a motor drive 66. Movement of the device 10 across the roof 2 will cause the fabric 12 to unroll over the roof 2. The fabric 12 may be completely unrolled over the length of the roof 2 or may be unrolled incrementally to expose individual sections of the roof 2 which may be completed before exposure of the next increment. As shown in FIGS. 3 and 4, as the fabric 12 unrolls, the diameter of the cylindrical shape of the rolled fabric 12 becomes smaller. The tension device 34 maintains the engagement means 60 in contact with the diminishing fabric roll 12 by drawing the rear end 20 of the frame 14 towards the purlin 6. FIG. 8 shows friction-reducing rollers 61 that engage the rolled fabric 12 which could also be powered by motors to move the device.

Thus it can be seen that the invention accomplishes at least all of its stated objectives.

I claim:

1. A fabric installation device for installing fabric on a building having a plurality of purlins, each purlin having a surface, the fabric being rolled into a cylindrical shape, the cylindrical shape having an axis positioned generally perpendicular to the purlin and having a length extending over at least two purlins, comprising:

an elongated frame having front and rear ends;

a purlin engagement means located proximal said frame front end and adapted to movably receive a surface of a purlin; and a fabric engagement means located proximal said frame rear end and extending therefrom to rotatable engage the roofing fabric against a surface of the purlins;

whereby movement of said fabric installation device on a purlin causes the fabric to unroll over the purlins.

2. A fabric installation device for installing roofing fabric on a roof having a plurality of parallel purlins, each purlin having an upper surface and a lower surface, the roofing fabric having an exposed end affixed to at least one purlin and being rolled into a cylindrical shape, the cylindrical shape having an axis positioned generally perpendicular to the purlins and having a length extending over at least two purlins, comprising:

an elongated frame having front and rear ends;

a first purlin engagement means located proximal said frame front end and adapted to movably receive the upper surface of a purlin;

a second purlin engagement means affixed to said elongated frame and adapted to movably receive the lower surface of a purlin, and;

a fabric engagement means connected to said elongated frame and extending downwardly therefrom to rotatable engage the roofing fabric against a surface of the purlins;

whereby movement of said fabric installation device on a purlin causes the roofing fabric to unroll over the purlins.

3. The fabric installation device of claim 2, wherein;

said elongated frame has an under side and a central portion between said front and rear ends;

said first purlin engagement means is affixed to said front end of said frame; and;

said second purlin engagement means is affixed to said central portion of said frame and includes;

tensioning means having an upper end and a lower end, said tensioning means extending downwardly forms said central portion of said frame; and contact means connected to said lower end of said tensioning means and adapted to movably engage the lower surface of the specific purlin; and a fabric engagement means connected to the underside of said frame proximal the upper end thereof and extending downwardly therefrom to mavably engage the roofing fabric;

whereby movement of said fabric installation device on the specific purlin away from the rearward end thereof causes the roofing fabric to unroll over the purlins.

4. The fabric installation device of claim 3 whereby said frame includes an elongated handle and said movement is caused by manipulation of said handle.

5. The fabric installation device of claim 4 wherein said second purlin engagement means comprises:

a U-shaped member having a central shaft and first and second ends, said first end having an extension having an axis substantially perpendicular to said elongated frame, said extension pivotally connected to said central portion of said elongated frame, said central shaft connected to and extending downwardly from said first end to said second end, said second end having an extension having an axis parallel to said extension of said first end to form an axle;

a wheel rotatably mounted on said axle and adapted to roll on the lower surface of a purlin;

a tension spring connected to said U-shaped member and extending upwardly therefrom to an upper end thereof; and a bolt adjustably connected to said frame at a position spaced apart from said first end of said U-shaped member, said bolt having a lower end being connected to said upper end of said tension spring.

6. The fabric installation device of claim 5 wherein said fabric engagement means comprises an elongated semi-cylindrical plate having a smooth inner surface that opens downwardly over the roofing fabric.

7. The fabric installation device of claim 3 whereby said frame includes a catch at the front end thereof and extending forwardly therefrom, said fabric installation device further comprising a line attached to said catch and extending forwardly therefrom whereby said movement is caused by pulling on said line.

8. The fabric installation device of claim 7 wherein said second purlin engagement means comprises:

a U-shaped member having a central shaft and first and second ends, said first end having an extension having an axis substantially perpendicular to said elongated frame, said extension pivotally connected to said central portion of said frame, said central shaft connected to and extending from said first end to said second end, said second end having an extension having an axis parallel to said extension of said first end to form an axle;

a wheel rotatably mounted on said axle and adapted to roll on the lower surface of a purlin;

a tension spring connected to said U-shaped member and extending upwardly therefrom to an upper end thereof; and a bolt adjustably connected to said frame at a position spaced apart from said first end of said U-shaped member, and said lower end of said bolt having a lower end being connected to said upper end of said tension spring.

9. The fabric installation device of claim 8 wherein said fabric engagement means comprises an elongated semi-cylindrical plate having a smooth inner surface that opens downwardly over the roofing fabric.

10. The fabric installation device of claim 7 wherein said line is attached to a motorized device that pulls on said line.

11. The fabric installation device of claim 10 wherein said motorized device is controllable by a remote device.

12. The device of claim 3 further comprising a motor mounted on said frame and operatively connected to drive means, said drive means being in engagement with a purlin whereby movement of said device is effected by said motor activating said drive means.

13. The fabric installation device of claim 12 wherein said second purlin engagement means comprises:

a U-shaped member having a central shaft and first and second ends, said first end having an extension having an axis substantially perpendicular to said elongated frame, said extension pivotally connected to said central portion of said frame, said central shaft connected to and extending from said first end to said second end, said second end having an extension extending orthogonally therefrom and parallel to said extension of said first end to form an axle;

a wheel rotatably mounted on said axle and adapted to roll on the lower surface of a purlin;

a tension spring connected to said U-shaped member and extending upwardly therefrom to an upper end thereof; and a bolt adjustably connected to said frame at a position spaced apart from said first end of said U-bolt, and said bolt having a lower end being connected to said upper end of said tension spring.

14. The fabric installation device of claim 13 wherein said fabric engagement means comprises an elongated semi-cylindrical plate having a smooth inner surface that opens downwardly over the roofing fabric.

15. The fabric installation device of claim 12 wherein said motor is controlled by a remote device.

* * * * *

UNITED STATES PATENT AND TRADEMARK OFFICE

CERTIFICATE OF CORRECTION

PATENT NO. : 6,247,288 B1
DATED : June 19, 2001
INVENTOR(S) : Daniel J. Harkins

It is certified that error appears in the above-identified patent and that said Letters Patent is hereby corrected as shown below:

Column 5,
Line 13, delete "rotatable", and insert -- rotatably --.
Lines 33-34, delete "rotatable", and insert -- rotatably --.
Line 47, delete "forms", and insert -- from --.
Line 51, delete "the", and insert -- a --.
Line 54, delete "mavably", and insert -- movably --.

Signed and Sealed this

Twenty-sixth Day of February, 2002

*Attest:*

*Attesting Officer*

JAMES E. ROGAN
*Director of the United States Patent and Trademark Office*